US008714914B2

(12) United States Patent
Cooper

(10) Patent No.: US 8,714,914 B2
(45) Date of Patent: May 6, 2014

(54) MOLTEN METAL PUMP FILTER

(76) Inventor: Paul V. Cooper, Chesterland, OH (US)

( * ) Notice: Subject to any disclaimer, the term of this patent is extended or adjusted under 35 U.S.C. 154(b) by 698 days.

(21) Appl. No.: 12/877,988

(22) Filed: Sep. 8, 2010

(65) Prior Publication Data

US 2011/0142603 A1 Jun. 16, 2011

Related U.S. Application Data

(60) Provisional application No. 61/240,620, filed on Sep. 8, 2009.

(51) Int. Cl.
*F04D 29/70* (2006.01)

(52) U.S. Cl.
USPC ..... 415/121.2

(58) Field of Classification Search
USPC ..... 415/121.2, 169.1; 416/247 R; 266/238
See application file for complete search history.

(56) References Cited

U.S. PATENT DOCUMENTS

| | | | |
|---|---|---|---|
| 35,604 | A | 6/1862 | Guild |
| 116,797 | A | 7/1871 | Barnhart |
| 209,219 | A | 10/1878 | Bookwalter |
| 251,104 | A | 12/1881 | Finch |
| 364,804 | A | 6/1887 | Cole |
| 390,319 | A | 10/1888 | Thomson |
| 495,760 | A | 4/1893 | Seitz |
| 506,572 | A | 10/1893 | Wagener |
| 585,188 | A | 6/1897 | Davis |
| 757,932 | A | 4/1904 | Jones |
| 882,477 | A | 3/1908 | Neumann |
| 882,478 | A | 3/1908 | Neumann |
| 890,319 | A | 6/1908 | Wells |
| 898,499 | A | 9/1908 | O'Donnell |
| 909,774 | A | 1/1909 | Flora |
| 919,194 | A | 4/1909 | Livingston |
| 1,037,659 | A | 9/1912 | Rembert |
| 1,100,475 | A | 6/1914 | Franckaerts |
| 1,170,512 | A | 2/1916 | Chapman |
| 1,196,758 | A | 9/1916 | Blair |
| 1,304,068 | A | 5/1919 | Krogh |
| 1,331,997 | A | 2/1920 | Neal |
| 1,377,101 | A | 5/1921 | Sparling |
| 1,380,798 | A | 6/1921 | Hansen et al. |
| 1,439,365 | A | 12/1922 | Hazell |
| 1,454,967 | A | 5/1923 | Gill |
| 1,470,607 | A | 10/1923 | Hazell |
| 1,513,875 | A | 11/1924 | Wilke |

(Continued)

FOREIGN PATENT DOCUMENTS

| | | |
|---|---|---|
| CA | 683469 | 3/1964 |
| CA | 2115929 | 8/1992 |

(Continued)

OTHER PUBLICATIONS

USPTO; Office Action dated Jan. 27, 2012 in U.S. Appl. No. 11/766,617.

(Continued)

*Primary Examiner* — Dwayne J White
(74) *Attorney, Agent, or Firm* — Snell & Wilmer L.L.P.

(57) ABSTRACT

The invention relates to filtering molten metal and more particularly, to a pump, pump base and filter for filtering molten metal, wherein the filter is preferably comprised of a ceramic foam material. The ceramic foam material may be buoyant in molten aluminum. In one embodiment, a molten metal pump includes a pump base configured to receive the molten metal pump filter without using cement.

31 Claims, 12 Drawing Sheets

(56) References Cited

U.S. PATENT DOCUMENTS 1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,038,221 A 4/1936 Kagi
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Heuer
2,300,688 A 11/1942 Nagle
2,304,849 A 12/1942 Ruthman
2,368,962 A 2/1945 Blom
2,383,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 9/1951 Jacobs
2,625,720 A 1/1953 Ross
2,626,086 A 1/1953 Forrest
2,676,279 A 4/1954 Wilson
2,677,609 A 5/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,839,006 A 2/1958 Mayo
2,832,292 A 4/1958 Edwards
2,853,019 A 9/1958 Thorton
2,865,295 A 12/1958 Nikolaus
2,865,618 A 12/1958 Abell
2,868,132 A 1/1959 Rittershofer
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,130,678 A 4/1964 Chenault
3,130,679 A 4/1964 Sence
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Louda
3,289,743 A 12/1966 Louda
3,291,473 A 12/1966 Sweeney et al.
3,374,943 A 3/1968 Cervenka
3,400,923 A 9/1968 Howie et al.
3,417,929 A 12/1968 Secrest et al.
3,432,336 A 3/1969 Langrod
3,459,133 A 8/1969 Scheffler
3,459,346 A 8/1969 Tinnes
3,477,383 A 11/1969 Rawson et al.
3,487,805 A 1/1970 Satterthwaite
1,185,314 A 3/1970 London
3,512,762 A 5/1970 Umbricht
3,512,788 A 5/1970 Kilbane
3,561,885 A 2/1971 Lake
3,575,525 A 4/1971 Fox et al.
3,618,917 A 11/1971 Fredrikson
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden
3,737,305 A 6/1973 Blayden et al.
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,941,588 A 3/1976 Dremann
3,941,589 A 3/1976 Norman et al.
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A 10/1976 Claxton et al.
3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Komiyama et al.
4,119,141 A 10/1978 Thut et al.
4,126,360 A 11/1978 Miller et al.
4,128,415 A 12/1978 van Linden et al.

(56) References Cited

U.S. PATENT DOCUMENTS 4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
4,989,736 A 2/1991 Andersson et al.
5,015,518 A 5/1991 Sasaki et al.
5,025,198 A 6/1991 Mordue et al.
5,028,211 A 7/1991 Mordue et al.
5,029,821 A 7/1991 Bar-on et al.
5,078,572 A 1/1992 Amra et al.
5,080,715 A 1/1992 Provencher et al.
5,088,893 A 2/1992 Gilbert et al.
5,092,821 A 3/1992 Gilbert et al.
5,098,134 A 3/1992 Monckton
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,505,435 A 4/1996 Laszlo
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.

(56) References Cited

U.S. PATENT DOCUMENTS

| | | | |
|---|---|---|---|
| 5,640,707 | A | 6/1997 | Nagel et al. |
| 5,640,709 | A | 6/1997 | Nagel et al. |
| 5,655,849 | A | 8/1997 | McEwen et al. |
| 5,660,614 | A | 8/1997 | Waite et al. |
| 5,662,725 | A | 9/1997 | Cooper |
| 5,676,520 | A | 10/1997 | Thut |
| 5,678,244 | A | 10/1997 | Shaw et al. |
| 5,678,807 | A | 10/1997 | Cooper |
| 5,679,132 | A | 10/1997 | Rauenzahn et al. |
| 5,685,701 | A | 11/1997 | Chandler et al. |
| 5,690,888 | A | 11/1997 | Robert |
| 5,695,732 | A | 12/1997 | Sparks et al. |
| 5,716,195 | A | 2/1998 | Thut |
| 5,717,149 | A | 2/1998 | Nagel et al. |
| 5,718,416 | A | 2/1998 | Flisakowski et al. |
| 5,735,668 | A | 4/1998 | Klien |
| 5,735,935 | A | 4/1998 | Areaux |
| 5,741,422 | A | 4/1998 | Eichenmiller et al. |
| 5,744,117 | A | 4/1998 | Wilkinson et al. |
| 5,745,861 | A | 4/1998 | Bell et al. |
| 5,772,324 | A | 6/1998 | Falk |
| 5,776,420 | A | 7/1998 | Nagel |
| 5,785,494 | A | 7/1998 | Vild et al. |
| 5,842,832 | A | 12/1998 | Thut |
| 5,858,059 | A | 1/1999 | Abramovich et al. |
| 5,863,314 | A | 1/1999 | Morando |
| 5,866,095 | A | 2/1999 | McGeever et al. |
| 5,875,385 | A | 2/1999 | Stephenson et al. |
| 5,935,528 | A | 8/1999 | Stephenson et al. |
| 5,944,496 | A | 8/1999 | Cooper |
| 5,947,705 | A | 9/1999 | Mordue et al. |
| 5,951,243 | A | 9/1999 | Cooper |
| 5,961,285 | A | 10/1999 | Meneice et al. |
| 5,963,580 | A | 10/1999 | Eckert |
| 5,992,230 | A | 11/1999 | Scarpa et al. |
| 5,993,726 | A | 11/1999 | Huang |
| 5,993,728 | A | 11/1999 | Vild |
| 6,019,576 | A | 2/2000 | Thut |
| 6,027,685 | A | 2/2000 | Cooper |
| 6,036,745 | A | 3/2000 | Gilbert et al. |
| 6,074,455 | A | 6/2000 | van Linden et al. |
| 6,082,965 | A | 7/2000 | Morando |
| 6,093,000 | A | 7/2000 | Cooper |
| 6,096,109 | A | 8/2000 | Nagel et al. |
| 6,113,154 | A | 9/2000 | Thut |
| 6,123,523 | A | 9/2000 | Cooper |
| 6,152,691 | A | 11/2000 | Thut |
| 6,168,753 | B1 | 1/2001 | Morando |
| 6,187,096 | B1 | 2/2001 | Thut |
| 6,199,836 | B1 | 3/2001 | Rexford et al. |
| 6,217,823 | B1 | 4/2001 | Vild et al. |
| 6,231,639 | B1 | 5/2001 | Eichenmiller |
| 6,250,881 | B1 | 6/2001 | Mordue et al. |
| 6,254,340 | B1 | 7/2001 | Vild et al. |
| 6,270,717 | B1 | 8/2001 | Tremblay et al. |
| 6,280,157 | B1 | 8/2001 | Cooper |
| 6,293,759 | B1 | 9/2001 | Thut |
| 6,303,074 | B1 | 10/2001 | Cooper |
| 6,345,964 | B1 | 2/2002 | Cooper |
| 6,354,796 | B1 | 3/2002 | Morando |
| 6,358,467 | B1 | 3/2002 | Mordue |
| 6,364,930 | B1 | 4/2002 | Kos |
| 6,371,723 | B1 | 4/2002 | Grant et al. |
| 6,398,525 | B1 | 6/2002 | Cooper |
| 6,439,860 | B1 | 8/2002 | Greer |
| 6,451,247 | B1 | 9/2002 | Mordue et al. |
| 6,457,940 | B1 | 10/2002 | Lehman |
| 6,457,950 | B1 | 10/2002 | Cooper et al. |
| 6,464,458 | B2 | 10/2002 | Vild et al. |
| 6,497,559 | B1 | 12/2002 | Grant |
| 6,500,228 | B1 | 12/2002 | Klingensmith et al. |
| 6,503,292 | B2 | 1/2003 | Klingensmith et al. |
| 6,524,066 | B2 | 2/2003 | Thut |
| 6,533,535 | B2 | 3/2003 | Thut |
| 6,551,060 | B2 | 4/2003 | Mordue et al. |
| 6,562,286 | B1 | 5/2003 | Lehman |
| 6,656,415 | B2 | 12/2003 | Kos |
| 6,679,936 | B2 | 1/2004 | Quackenbush |
| 6,689,310 | B1 | 2/2004 | Cooper |
| 6,709,234 | B2 | 3/2004 | Gilbert et al. |
| 6,723,276 | B1 | 4/2004 | Cooper |
| 6,805,834 | B2 | 10/2004 | Thut |
| 6,843,640 | B2 | 1/2005 | Mordue et al. |
| 6,848,497 | B2 | 2/2005 | Sale et al. |
| 6,869,271 | B2 | 3/2005 | Gilbert et al. |
| 6,869,564 | B2 | 3/2005 | Gilbert et al. |
| 6,881,030 | B2 | 4/2005 | Thut |
| 6,887,424 | B2 | 5/2005 | Ohno et al. |
| 6,887,425 | B2 | 5/2005 | Mordue et al. |
| 6,902,696 | B2 | 6/2005 | Klingensmith et al. |
| 7,037,462 | B2 | 5/2006 | Klingensmith |
| 7,083,758 | B2 | 8/2006 | Tremblay |
| 7,131,482 | B2 | 11/2006 | Vincent et al. |
| 7,157,043 | B2 | 1/2007 | Neff |
| 7,279,128 | B2 | 10/2007 | Kennedy et al. |
| 7,326,028 | B2 | 2/2008 | Morando |
| 7,402,276 | B2 | 7/2008 | Cooper |
| 7,470,392 | B2 | 12/2008 | Cooper |
| 7,476,357 | B2 | 1/2009 | Thut |
| 7,497,988 | B2 | 3/2009 | Thut |
| 7,507,367 | B2 | 3/2009 | Cooper |
| 7,543,605 | B1 | 6/2009 | Morando |
| 7,906,068 | B2 | 3/2011 | Cooper |
| 8,110,141 | B2 | 2/2012 | Cooper |
| 8,361,379 | B2 | 1/2013 | Cooper |
| 8,366,993 | B2 | 2/2013 | Cooper |
| 2001/0000465 | A1 | 4/2001 | Thut |
| 2002/0146313 | A1 | 10/2002 | Thut |
| 2002/0185794 | A1 | 12/2002 | Vincent |
| 2003/0047850 | A1 | 3/2003 | Areaux |
| 2003/0082052 | A1 | 5/2003 | Gilbert et al. |
| 2003/0201583 | A1 | 10/2003 | Klingensmith |
| 2004/0050525 | A1 | 3/2004 | Kennedy et al. |
| 2004/0076533 | A1 | 4/2004 | Cooper |
| 2004/0115079 | A1 | 6/2004 | Cooper |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0116398 | A1 | 6/2005 | Tremblay |
| 2006/0180963 | A1 | 8/2006 | Thut |
| 2007/0253807 | A1 | 11/2007 | Cooper |
| 2008/0213111 | A1 | 9/2008 | Cooper |
| 2008/0230966 | A1 | 9/2008 | Cooper |
| 2011/0140319 | A1 | 6/2011 | Cooper |
| 2013/0214014 | A1 | 8/2013 | Cooper |

FOREIGN PATENT DOCUMENTS

| | | |
|---|---|---|
| CA | 2176475 | 5/1996 |
| CA | 2244251 | 12/1996 |
| CA | 2305865 | 2/2000 |
| CH | 392268 | 9/1965 |
| DE | 1800446 | 12/1969 |
| EP | 0168250 | 1/1986 |
| EP | 0665378 | 2/1995 |
| EP | 1019635 | 6/2006 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| MX | 227385 | 4/2005 |
| NO | 90756 | 1/1959 |
| RU | 416401 | 2/1974 |
| RU | 773312 | 10/1980 |
| WO | 9808990 | 3/1998 |
| WO | 9825031 | 11/1998 |
| WO | 0009889 | 2/2000 |
| WO | 0212147 | 2/2002 |

(56) References Cited

FOREIGN PATENT DOCUMENTS

WO 2004029307 4/2004

OTHER PUBLICATIONS

USPTO; Notice of Allowance dated May 15, 2012 in U.S. Appl. No. 11/766,617.
USPTO; Notice of Allowance dated Nov. 28, 2011 in U.S. Appl. No. 12/120,190.
USPTO; Notice of Allowance dated Feb. 6, 2012 in U.S. Appl. No. 12/120,190.
USPTO; Final Office Action dated Feb. 3, 2012 in U.S. Appl. No. 12/120,200.
USPTO; Final Office Action dated Jun. 8, 2012 in U.S. Appl. No. 12/264,416.
USPTO; Final Office Action dated Dec. 13, 2011 in U.S. Appl. No. 12/395,430.
USPTO; Advisory Action dated Feb. 22, 2012 in U.S. Appl. No. 12/395,430.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Apr. 19, 2012 in U.S. Appl. No. 12/853,268.
USPTO; Office Action dated May 29, 2012 in U.S. Appl. No. 12/878,984.
USPTO; Final Office Action dated Feb. 16, 2012 in U.S. Appl. No. 12/880,027.
USPTO; Final Office Action dated Dec. 16, 2011 in U.S. Appl. No. 13/047,719.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Apr. 18, 2012 in U.S. Appl. No. 13/252,145.
CIPO; Notice of Allowance dated Jan. 15, 2008 in Application No. 2,244,251.
"Response to Final Office Action and Request for Continued Examination for U.S. Appl. No. 09/275,627," Including Declarations of Haynes and Johnson, Apr. 16, 2001.
Document No. 504217: Excerpts from "Pyrotek Inc.'s Motion for Summary Judgment of Invalidity and Unenforceability of U.S. Patent No. 7,402,276," Oct. 2, 2009.
Document No. 505026: Excerpts from "MMEI's Response to Pyrotek's Motion for Summary Judgment of Invalidity or Enforceability of U.S. Patent No. 7,402,276," Oct. 9, 2009.
Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.
Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Feb. 23, 1996 in U.S. Appl. No. 08/439,739.
USPTO; Office Action dated Aug. 15, 1996 in U.S. Appl. No. 08/439,739.
USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15, 1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 14, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.

(56) References Cited

OTHER PUBLICATIONS

USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance Apr., 18, 2008 in U.S. Appl. No. 10/773,102.
USPTO; Office Action dated Jul. 24, 2006 in U.S. Appl. No. 10/773,105.
USPTO; Final Office Action dated Jul. 21, 2007 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.

(56) References Cited

OTHER PUBLICATIONS

USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated May 22, 2009 in U.S. Appl. No. 12/369,362.
USPTO; Final Office Action dated Dec. 14, 2009 in U.S. Appl. No. 12/369,362.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Aug. 25, 2011 in U.S. Appl. No. 13/047,747.
USPTO; Office Action dated Aug. 25, 2011 in U.S. Appl. No. 13/047,719.
USPTO; Office Action dated Aug. 27, 2001 in U.S. Appl. No. 90/005,910.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Notice of Allowance dated Jan. 15, 200 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Office Action dated Sep. 22, 2011 in U.S. Appl. No. 11/766,617.
USPTO; Notice of Allowance dated Nov. 1, 2011 in U.S. Appl. No. 12/146,770.
USPTO; Office Action dated Nov. 4, 2011 in U.S. Appl. No. 12/264,416.
USPTO; Office Action dated Sep. 22, 2011 in U.S. Appl. No. 12/880,027.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Notice of Allowance dated Jan. 17, 2013 in U.S. Appl. No. 12/120,200.
USPTO; Office Action dated Nov. 28, 2012 in U.S. Appl. No. 12/264,416.
USPTO; Ex Parte Quayle dated Apr. 3, 2013 in U.S. Appl. No. 12/264,416.
USPTO; Notice of Allowance dated Sep. 20, 2012 in U.S. Appl. No. 12/395,430.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Notice of Allowance dated Oct. 2, 2012 in U.S. Appl. No. 12/853,253.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated Oct. 3, 2012 in U.S. Appl. No. 12/878,984.
USPTO; Final Office Action dated Jan. 25, 2013 in U.S. Appl. No. 12/878,984.
USPTO; Notice of Allowance dated Mar. 28, 2013 in U.S. Appl. No. 12/878,984.
USPTO; Office Action dated Dec. 14, 2012 in U.S. Appl. No. 12/880,027.
USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Dec. 13, 2012 in U.S. Appl. No. 13/047,747.
USPTO; Notice of Allowance dated Apr. 3, 2013 in U.S. Appl. No. 13/047,747.

(56) References Cited

OTHER PUBLICATIONS

USPTO; Office Action dated Apr. 12, 2013 in U.S. Appl. No. 13/106,853.
USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Apr. 13, 2009 in U.S. Appl. No. 12/264,416.
USPTO; Final Office Action dated Jul. 11, 2013 in U.S. Appl. No. 12/880,027.
USPTO; Notice of Allowance dated Aug. 23, 2013 in U.S. Appl. No. 13/106,853.
USPTO; Office Action dated Sep. 18, 2013 in U.S. Appl. No. 13/752,312.
USPTO; Office Action dated Sep. 6, 2013 in U.S. Appl. No. 13/725,383.
USPTO; Office Action dated Sep. 11, 2013 in U.S. Appl. No. 13/756,468.
USPTO; Office Action dated Dec. 18, 2013 in U.S. Appl. No. 12/853,238.
USPTO; Office Action dated Dec. 18, 2013 in U.S. Appl. No. 12/895,796.
USPTO; Office Action dated Oct. 24, 2013 in U.S. Appl. No. 13/725,383.

MOLTEN METAL PUMP FILTER

PRIORITY CLAIM

This application claims priority to U.S. Provisional Application 61/240,620 entitled "Molten Metal Pump Filter," filed on Sep. 8, 2009 and invented by Paul V. Cooper. The drawings and pages 21-25 of that application are incorporated herein by reference.

FIELD OF THE INVENTION

The invention relates to filtering molten metal and more particularly, to a device for filtering molten metal.

BACKGROUND OF THE INVENTION

As used herein, the term "molten metal" means any metal or combination of metals in liquid form, such as aluminum, copper, iron, zinc, and alloys thereof. The term "gas" means any gas or combination of gases, including argon, nitrogen, chlorine, fluorine, Freon, and helium, which may be released into molten metal.

A reverbatory furnace is used to melt metal and retain the molten metal while the metal is in a molten state. The molten metal in the furnace is sometimes called the molten metal bath. Reverbatory furnaces usually include a chamber for retaining a molten metal pump and that chamber is sometimes referred to as the pump well.

Known pumps for pumping molten metal (also called "molten-metal pumps") include a pump base (also called a "base", "housing" or "casing") and a pump chamber (or "chamber" or "molten metal pump chamber"), which is an open area formed within the pump base. Such pumps also include one or more inlets in the pump base, an inlet being an opening to allow molten metal to enter the pump chamber.

A discharge is formed in the pump base and is a channel or conduit that communicates with the molten metal pump chamber, and leads from the pump chamber to the molten metal bath. A tangential discharge is a discharge formed at a tangent to the pump chamber. The discharge may also be axial, in which case the pump is called an axial pump. In an axial pump the pump chamber and discharge may be the essentially the same structure (or different areas of the same structure) since the molten metal entering the chamber is expelled directly through (usually directly above or below) the chamber.

A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and the two are coupled by a coupling, which is usually comprised of steel.

As the motor turns the drive shaft, the drive shaft turns the rotor and the rotor pushes molten metal out of the pump chamber, through the discharge, which may be an axial or tangential discharge, and into the molten metal bath. Most molten metal pumps are gravity fed, wherein gravity forces molten metal through the inlet and into the pump chamber as the rotor pushes molten metal out of the pump chamber.

Molten metal pump casings and rotors usually, but not necessarily, employ a bearing system comprising ceramic rings wherein there are one or more rings on the rotor that align with rings in the pump chamber such as rings at the inlet (which is usually the opening in the housing at the top of the pump chamber and/or bottom of the pump chamber) when the rotor is placed in the pump chamber. The purpose of the bearing system is to reduce damage to the soft, graphite components, particularly the rotor and pump chamber wall, during pump operation. A known bearing system is described in U.S. Pat. No. 5,203,681 to Cooper, the disclosure of which is incorporated herein by reference. U.S. Pat. Nos. 5,951,243 and 6,093,000, each to Cooper, the disclosures of which are incorporated herein by reference, disclose, respectively, bearings that may be used with molten metal pumps and rigid coupling designs and a monolithic rotor. U.S. Pat. No. 2,948,524 to Sweeney et al., U.S. Pat. No. 4,169,584 to Mangalick, and U.S. Pat. No. 6,123,523 to Cooper (the disclosure of the afore-mentioned patent to Cooper is incorporated herein by reference) also disclose molten metal pump designs. U.S. Pat. No. 6,303,074 to Cooper, which is incorporated herein by reference, discloses a dual-flow rotor, wherein the rotor has at least one surface that pushes molten metal into the pump chamber.

The materials forming the molten metal pump components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a launder, ladle, or another furnace. Examples of transfer pumps are disclosed in U.S. Pat. No. 6,345,964 B1 to Cooper, the disclosure of which is incorporated herein by reference, and U.S. Pat. No. 5,203,681.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end of the gas-transfer conduit and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper. Furthermore, gas may be released into a stream of molten metal passing through a discharge or metal-transfer conduit wherein the position of a gas-release opening in the metal-transfer conduit enables pressure from the molten metal stream to assist in drawing gas into the molten metal stream. Such a structure and method is disclosed in U.S. application Ser. No. 10/773,101 entitled "System for Releasing Gas into Molten Metal", invented by Paul V. Cooper, and filed on Feb. 4, 2004, the disclosure of which is incorporated herein by reference.

Molten metal transfer pumps have been used, among other things, to transfer molten aluminum from a well to a ladle or launder, wherein the launder normally directs the molten aluminum into a ladle or into molds where it is cast into solid, usable pieces, such as ingots.

Various filters have been utilized to remove impurities from the molten metal. These include single or double vertical gate filters, bonded particle filters, and cartridge filters. Vertical gate filters serve as walls between hearths and dip-out wells in melting or holding furnaces to remove inclusions. Bonded particle filtration can be used to remove oxides from molten aluminum and its alloys. Bonded particle filters may be in cylindrical, plate or custom shapes, and are available in various porosity and multiple grit levels.

First, known filters are often required to be semi-permanently cemented in place. This, results in increased maintenance time to remove and replace the filter. Also, relatively fragile bonded or sintered materials can break apart from the filter during use, which can result in inclusions that enter the molten metal being pumped and negatively affect the finished product or adversely affect pumping equipment.

SUMMARY OF THE INVENTION

The invention relates to filtering molten metal and, more particularly, to a filter for filtering molten metal. The filter preferably comprises (1) a ceramic foam material that preferably has a density less than the material used to make the pump base in which it is positioned, and which is preferably buoyant in molten aluminum, and/or (2) a gasket that helps retain it in the pump base. The invention also includes a pump base including the filter and a pump including the filter.

One embodiment of the invention comprises a molten metal pump including (1) a pump base configured to receive a molten metal pump filter, and (2) a molten metal pump filter, positioned in the pump base, the filter comprised of a ceramic foam material. The molten metal pump filter (sometimes referred to herein as just "filter" or "molten metal filter") may further comprise an expandable gasket attached to the filter to the filter, wherein the gasket is configured to expand when heated to help retain the filter in the pump chamber of the pump base. The molten metal pump base preferably comprises a tapered opening configured to receive the molten metal pump filter, which preferably has tapered, or angled, sides.

The molten metal pump filter is preferably not (although it may be if it utilizes a gasket and is not cemented in place) comprised of bonded refractory material and/or a sintered refractory material and/or silicon carbide, and is preferably not cemented to the molten metal pump.

A filter according to the invention may be replaced in a pump that has not substantially cooled after being removed from a molten metal bath. This can greatly reduce time needed for repairs or replacement as the filter is not cemented in place.

Both the foregoing general description and the following detailed description are exemplary and explanatory only and are not restrictive of the invention as claimed.

DETAILED DESCRIPTION OF PREFERRED EMBODIMENTS

Figure 1A:
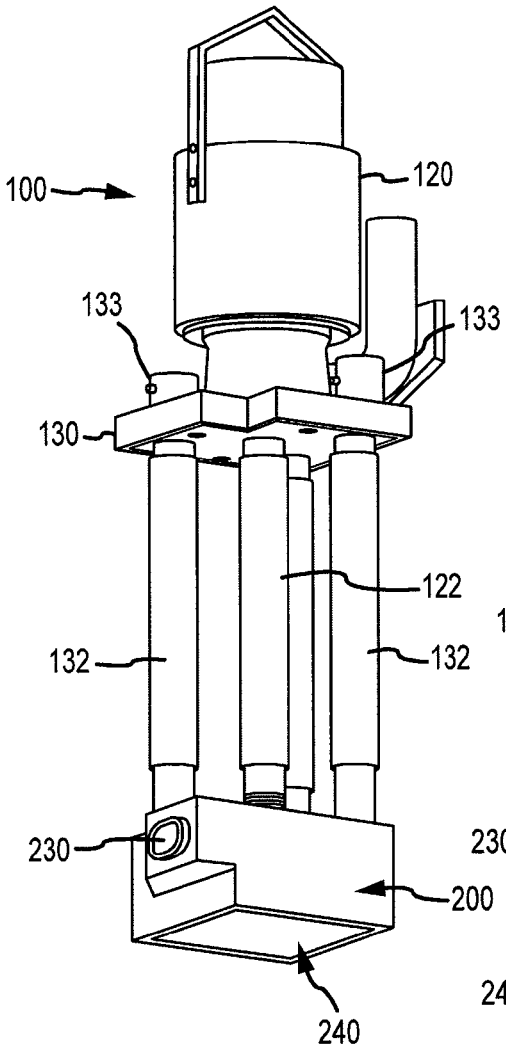
FIG. 1A depicts a molten metal pump and filter system according to one embodiment of the invention.

Reference will now be made in detail to the present exemplary embodiments of the invention, examples of which are illustrated in the accompanying drawings. FIG. 1A depicts a molten metal pump 100 according to one embodiment the invention. When in operation, pump 100 is typically positioned in a molten metal bath in a pump well, which is typically part of the open well of a reverbatory furnace. Pump 100 comprises a motor 120, superstructure 130, support posts 132, a drive shaft that preferably includes a motor shaft (not shown) coupled to rotor shaft 122, a rotor 110 (shown, for example, in FIG. 2), base (also called a housing or casing) 200, with a pump chamber 210 and filter 240.

The pump of the invention may be a circulation pump, gas-release (also called a gas-injection pump) or a transfer pump. The pump of the invention is a bottom-feed pump, which, as known to those skilled in the art, is designed to permit molten metal to enter into the pump chamber 210 through the bottom (and hence, through filter 240). Base 200 further includes a tangential discharge 215 that leads from pump chamber 210 to an outlet port (also called an outlet or output port) 230. As molten metal enters the pump chamber 210 through the bottom (so the inlet or input port of chamber 210 is its bottom opening in base 200), the rotor 110 rotates and pushes the molten metal through discharge 215 and out of outlet port 230.

The exemplary filter 240 filters materials from the molten metal. The filter 240 is received within the base 200, and as shown is received in the bottom opening of pump chamber 210. The filter 240 may be any suitable size, shape, and configuration, though the exemplary filter as depicted is trapezoidal with the top surface being smaller than the bottom surface, and having angled sidewalls. The filter 240 may be made from any suitable material, such as bonded or sintered refractory material, and/or silicon carbide. In the preferred embodiment, the filter 240 is comprised of a ceramic foam material manufactured by Selee Corporation. The filter 240 may have any desired porosity, and may include pores of different sizes, although it is preferred that filter 240 have a density less than that of the material from which base 200 is formed and be buoyant in molten aluminum.

In the embodiment shown, each of the sides of the molten metal pump filter 240 are pitched at between approximately a 1 degree and approximately a 45 degree angle. Preferably, the pitch is approximately a 15 degree angle.

The filter 240 may include a gasket 240A which is preferably adhesively applied to each of the sides of filter 240, although it may be applied to fewer than all sides or to a portion of one or more sides, or at any suitable position(s). When the filter 240 is positioned in the pump base 200, the gasket 240A is disposed at least partially between the filter 240 and the base 200 to help position filter 240 within the base 200. The gasket may be comprised from any material(s) that can help retain the filter 240 and that is suitable for use in a molten metal environment, and only enough gasket material may be used to properly position the filter 240 in pump base 200. Alternatively, if a porous ceramic material is used that is buoyant in molten aluminum, a gasket may not be required because the buoyancy of the filter may hold it in place since it is on the bottom of the pump base 200. In that case the filter 240 might be slightly oversized so it can be pressure fit into the opening in pump base 200 in which filter 240 is retained.

The filter 240 may also include temperature sensors and/or indicators. These sensors or indicators may be external to the filter or integral to the filter 240. Any type of sensor or indicator may be used, such as electronic or chemical temperature sensors or indicators. In one embodiment of the present invention, the filter is configured to change color in response to changes in temperature to give a visual indicator of the temperature of the filter and/or its surrounding environment. Alternatively, a filter 240 of the present invention may operate in conjunction with an electronic temperature sensor that provides a visual and/or audial indicator of the temperature of the filter 240 and/or its surrounding environment.

The various components of pump 100 that are exposed to the molten metal (such as support posts 132, drive shaft 122, rotor (also called an impeller) 110, and base 200) are preferably formed from materials resistant to degradation in molten metal, such as structural refractory materials. Carbonaceous refractory materials, such as carbon of a dense or structural type, including graphite, graphitized carbon, clay-bonded graphite, carbon-bonded graphite, or the like have all been found to be most suitable because of cost and ease of machining. Components made of carbonaceous refractory materials may be treated with one or more chemicals to make the components more resistant to oxidation. Oxidation and erosion treatment for graphite parts are practiced commercially, and graphite so treated can be obtained from sources known to those skilled in the art.

Pump 100 need not be limited to the structure depicted in FIG. 1A, but can be any structure or device for pumping or otherwise conveying molten metal, such as the pump disclosed in U.S. Pat. No. 5,203,681 to Cooper. Preferred pump 100 has a pump base 200 for being at least partially submerged in a molten metal bath. Pump base 200 preferably includes a pump chamber 210 in which the rotor 110 and filter 240 are each at least partially positioned. When assembled, there is a space of about ½" to 2", and preferably about 1", between the bottom of the rotor 110 and the top surface of filter 240. The bottom of chamber 210 that receives the filter 240 is configured to receive and retain it. Based on the shape of filter 240, the bottom surface of chamber 210 in which filter 240 is positioned can be trapezoidal, cubical or cylindrical, although it may be of any suitable shape. In the embodiment shown, the lower surface of pump chamber 210 has angled walls that generally align with the angled sides of filter 240.

One preferred embodiment of the present invention includes one or more support posts 132 each of which is connected at one end to base 200 and at the other end to a superstructure (or platform) 130 of pump 100. The base 200 thus supports superstructure 130 when the pump 100 is in use. Additionally, pump 100 could be of any other construction suitable for pumping molten metal. For example, the motor 120 and drive shaft could be suspended without a superstructure 130, wherein they are supported, directly or indirectly, to a structure independent of the pump base 200. Also, the pump may not have a pump base, but may be of the type described in U.S. application Ser. No. 12/853,238 to Cooper, filed on Aug. 9, 2010 and entitled "Quick Submergence Molten Metal Pump," the disclosure of which is incorporated herein by reference.

In the preferred embodiment, post clamps 133 secure posts 132 to superstructure 130. A preferred post clamp and preferred support posts are disclosed in copending U.S. application Ser. No. 10/773,118 entitled "Support Post System for Molten Metal Pump," invented by Paul V. Cooper, and filed on Feb. 4, 2004, the disclosure of which is incorporated herein by reference. However, any system or device for securing posts to superstructure 130 may be used.

A motor 120, which can be any structure, system or device suitable for driving pump 100, but is preferably an electric or pneumatic motor, is positioned on superstructure 130 and is connected to an end of drive shaft. The drive shaft has a first end and a second end, wherein the first end of the drive shaft connects to motor 120 and the second end of the drive shaft connects to the rotor 110. The drive shaft can be any structure suitable for rotating a rotor, and preferably comprises a motor shaft (not shown), which is preferably made of steel, coupled to a rotor shaft 122, which is preferably comprised of one or more of silicon carbide and graphite. Rotor shaft 122 has a first end and a second end, wherein the first end is connected to the coupling (that in turn connects to the motor shaft) and the second end is connected to rotor 110. In a preferred coupling, rotor shaft 122 and the type of connection between the rotor shaft 122 and rotor 110 are disclosed in U.S. Pat. No. 7,470,392 entitled "Molten Metal Pump Components," invented by Paul V. Cooper and filed on Feb. 4, 2004, the disclosure of which is incorporated herein by reference.

Rotor 110 can be any rotor suitable for use in a molten metal pump and the term "rotor," as used in connection with this invention, means any device or rotor used in a molten metal pump chamber to displace molten metal, and that may be used in a bottom-feed pump. The preferred dimensions of rotor 110 will depend upon the size of pump 100.

Rotor 110 can be comprised of a single material, such as graphite or ceramic, or can be comprised of different materials. Any part or all of rotor 110 may also include a protective coating as described in co-U.S. Pat. No. 7,507,367 entitled "Protective Coatings for Molten Metal Devices," invented by Paul V. Cooper and filed on Jul. 14, 2003.

Figure 2:
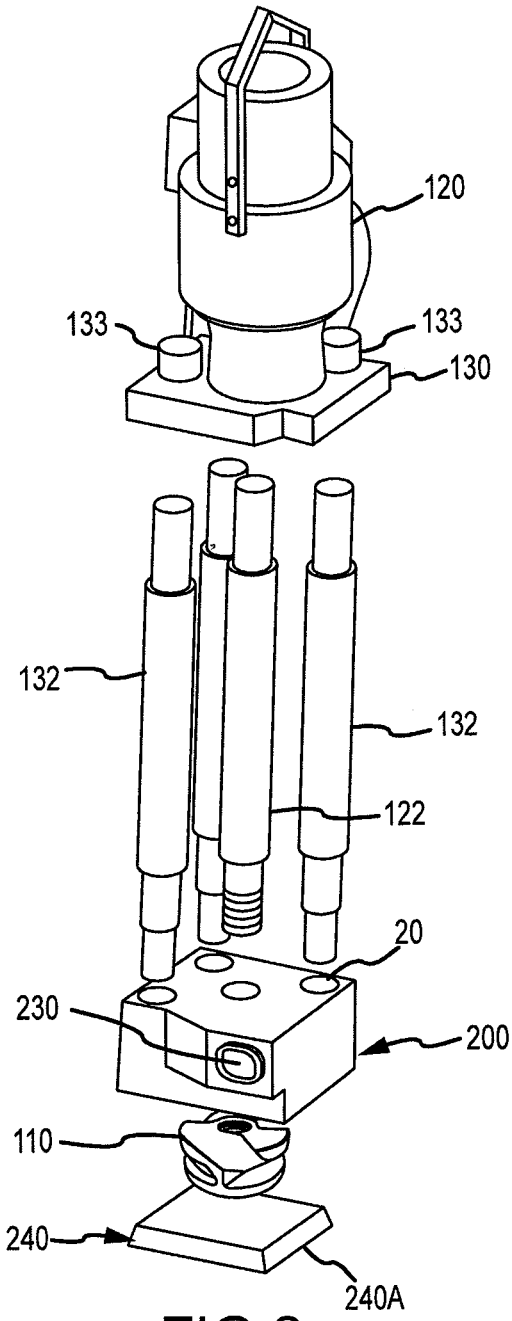
FIG. 2 depicts an exploded view of the molten metal pump and filter system shown in FIGS. 1A and 1B.

The rotor 110 preferably comprises one or more imperforate rotor blades (as best seen in FIG. 2), although it may include any structure suitable for displacing molten metal through the discharge 215, such as perforate rotor blades or another perforate structure. In one embodiment, the rotor has three rotor blades, or vanes, for displacing molten metal, although any number of vanes could be used. Preferably each vane has a portion that directs molten metal into chamber 210 and a portion that directs molten metal outward towards the wall of chamber 210. In the preferred embodiment each vane has the same configuration (although the respective vanes could have different configurations).

Figure 1B:
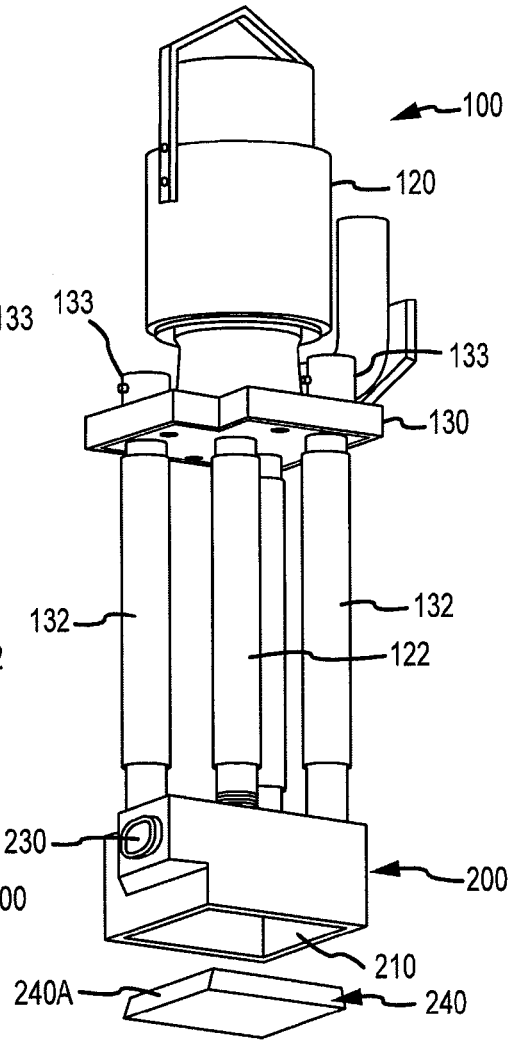
FIG. 1B depicts the molten metal pump and filter system shown in FIG. 1A with the filter shown separately.

FIG. 1B depicts the molten metal pump shown in FIG. 1A with filter 240 removed from the bottom of the pump casing 200. The molten metal pump in FIG. 1B shows the molten metal filter 240 removed from the pump chamber 210 of pump base 200. FIG. 2 depicts an exploded view of the system depicted in FIGS. 1A and 1B and shows rotor 110 and filter 240 outside of the pump chamber 210.

The base 200 includes pump chamber 210, which houses the rotor 110 and the filter 240 when the pump 100 is assembled. Base 200 also comprises a discharge 215 leading from the pump chamber 210 to the outlet port 230.

Figure 3:
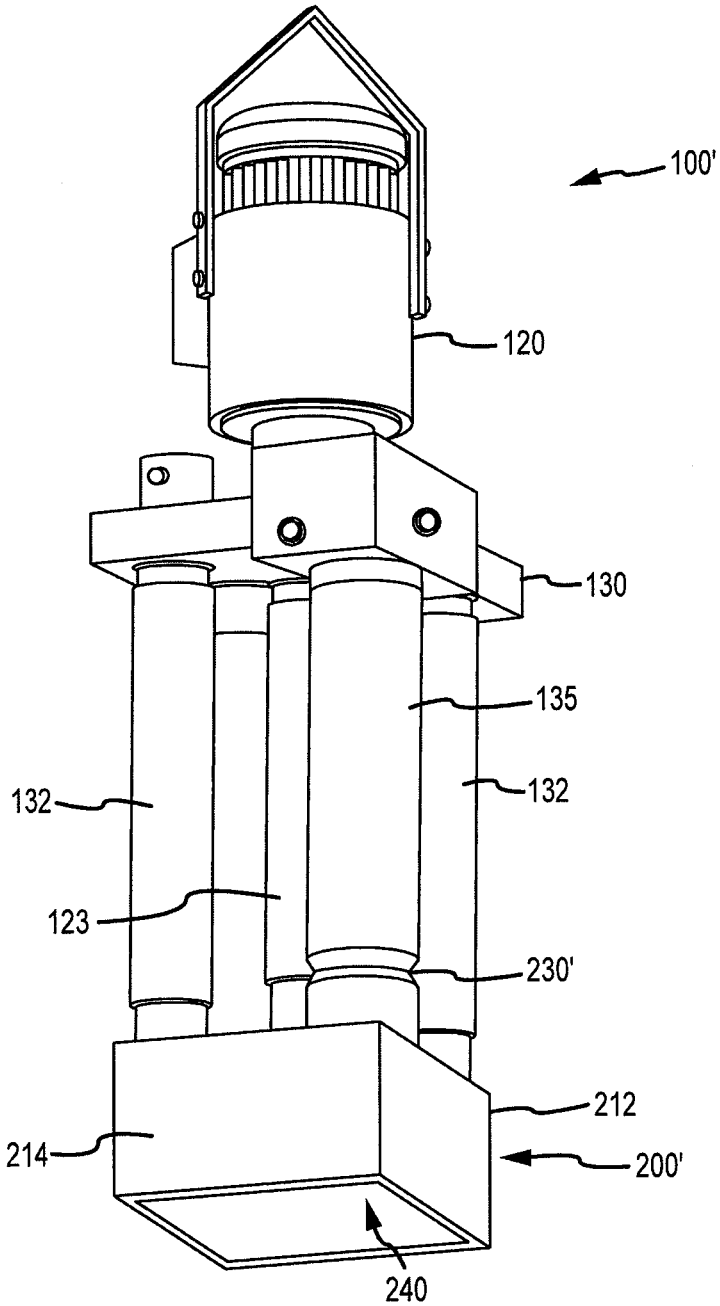
FIG. 3 depicts a transfer pump embodiment comprising a molten metal pump with riser and filter system.
Figure 4:
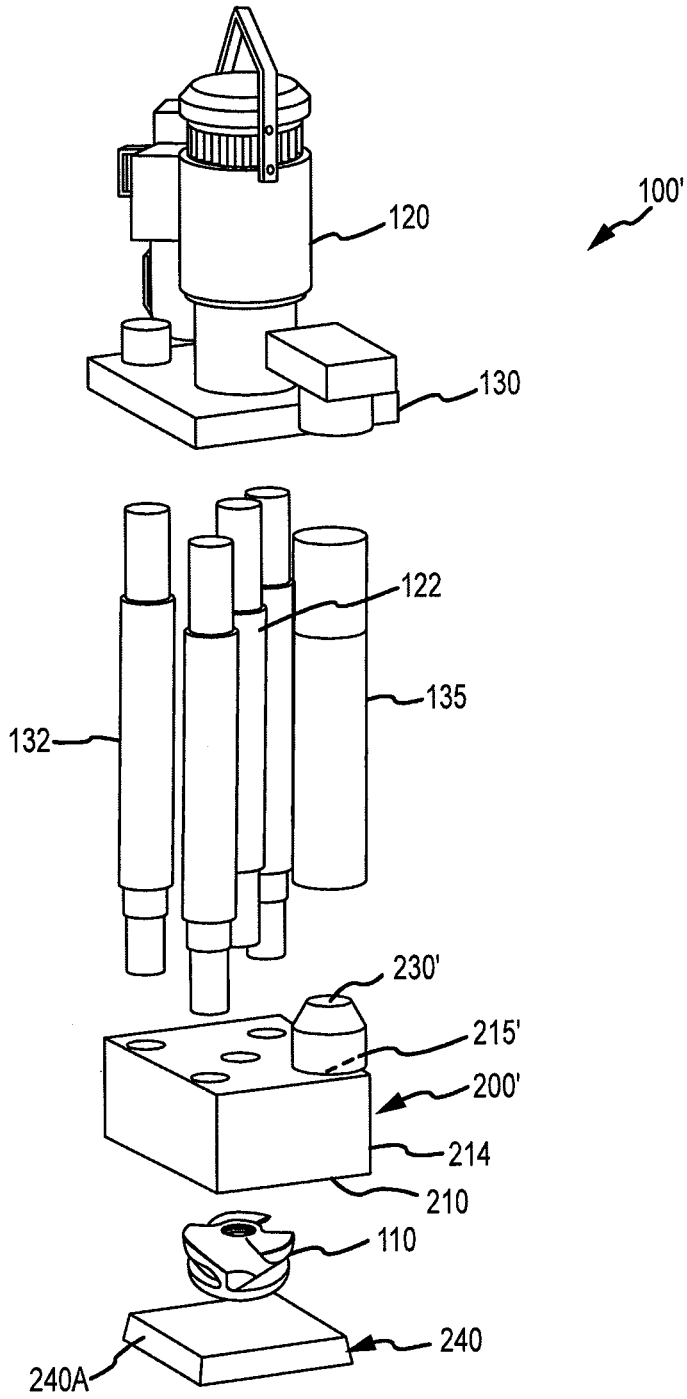
FIG. 4 depicts an exploded view of the molten metal transfer pump and filter system as shown in FIG. 3.
Figure 5C:
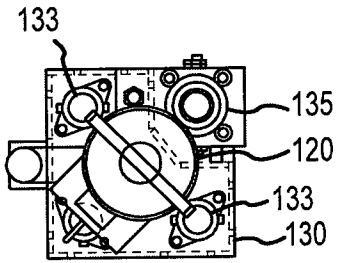
FIG. 5C depicts a top view of the motor mount with components of the embodiment as shown in FIGS. 3, 4, 5A, and 5B.
Figure 5D:
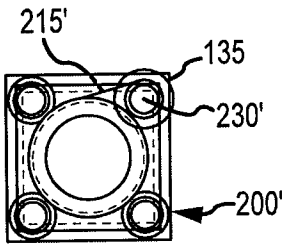
FIG. 5D depicts a top view of the base of the embodiment as shown in FIGS. 3, 4, 5A, 5B, and 5C.
Figure 5B:
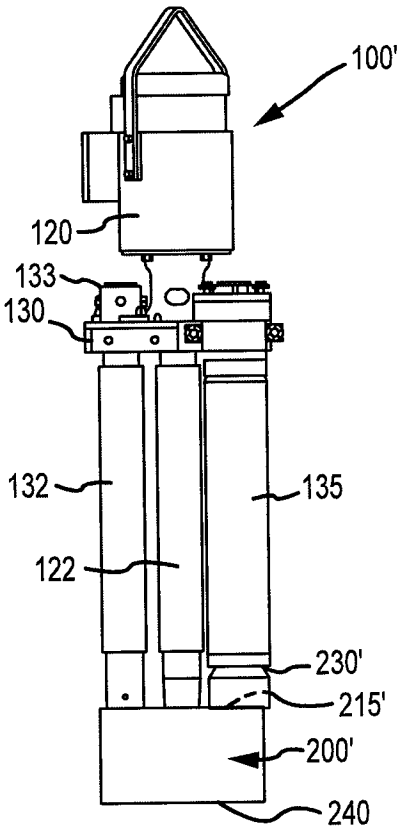
FIG. 5B depicts another side view of the molten metal transfer pump and filter system as shown in FIGS. 3, 4, and 5A.
Figure 5A:
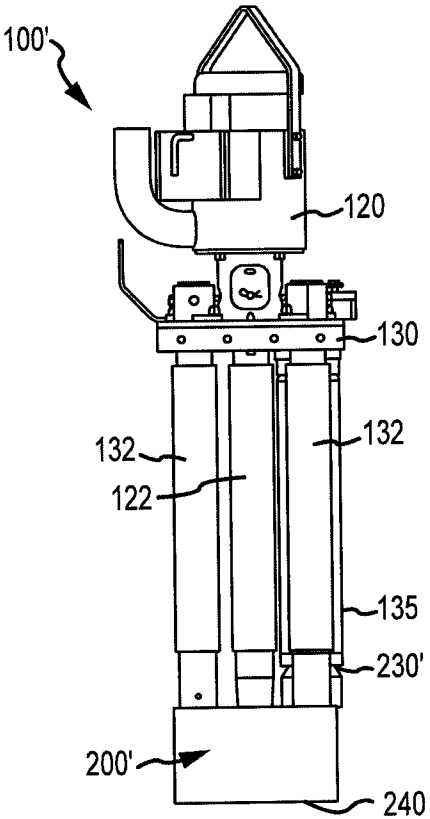
FIG. 5A depicts a side view of the molten metal transfer pump and filter system as shown in FIGS. 3 and 4.
Figure 6D:
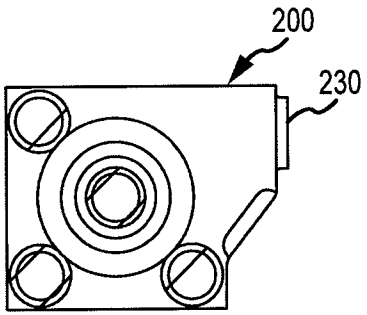
FIG. 6D depicts a top view of the base of the embodiment as shown in FIGS. 1A, 1B, 2, 6A, 6B, and 6C.
Figure 6C:
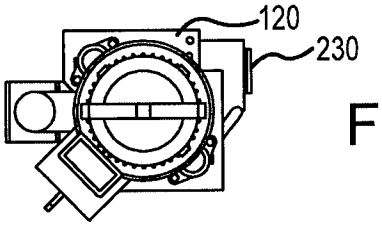
FIG. 6C depicts a top view of the motor mount with components of the embodiment as shown in FIGS. 1A, 1B, 2, 6A, and 6B.
Figure 6B:
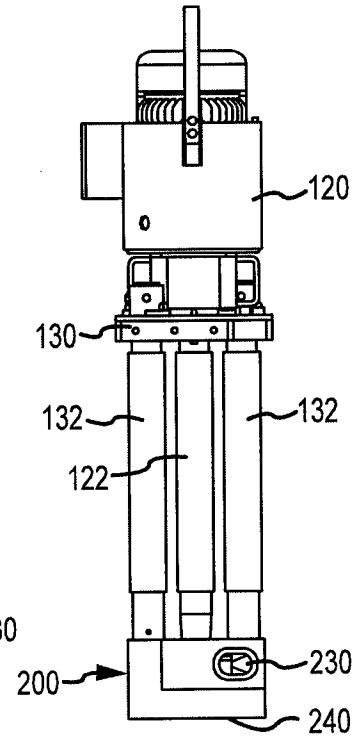
FIG. 6B depicts another side view of the molten metal pump and filter system as shown in FIGS. 1A, 1B, 2, and 6A.
Figure 6A:
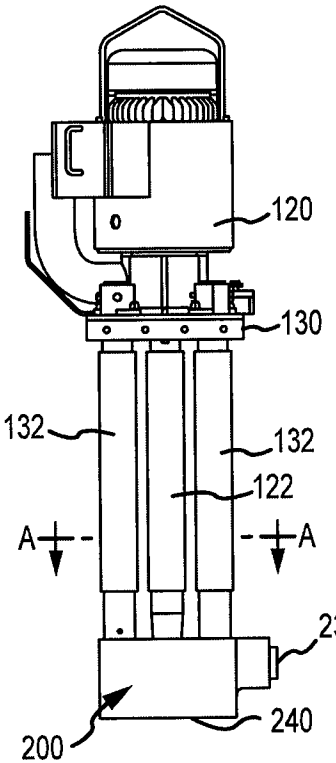
FIG. 6A depicts a side view of the molten metal pump and filter system as shown in FIGS. 1A, 1B, and 2.

FIG. 3 depicts another embodiment of the system, which is a transfer pump 100' wherein a riser tube is coupled to the outlet port 230'. FIG. 4 depicts an exploded view of the system depicted in FIG. 3. In this embodiment, outlet port 230 is formed in the top surface of base 200 and is coupled to the riser tube 135. However, outlet port 230' may also be formed in a side or bottom section of base 200, as long as it is ultimately connected to a riser tube (also called a metal-transfer conduit) to direct the molten metal upwards. Transfer pumps of this basic configuration are known in the art. In this pump, the configuration and functioning of the pump housing 200', rotor 110 and filter 240 all function in the manner previously described with respect to pump 100.

FIGS. 5A, 5B, 5C, and 5D illustrate different views and include exemplary dimensions for the pump 100' of FIG. 3. Any pump used in the present invention may have any suitable dimensions. In this embodiment the height of the base 200' is approximately 7.875 inches and the width of each of the four side surfaces of the base 200' is approximately 14 inches. As shown, in this embodiment, the width of each of the four sides of the superstructure 130 is approximately 16 inches. In this embodiment the support posts 132 are between approximately 18 inches to approximately 33 inches tall. The base 200' and/or superstructure 130 may be any other suitable size, shape and configuration.

FIGS. 6A, 6B, 6C, and 6D depict the pump 100 of FIGS. 1A and 1B. In this exemplary embodiment, the structure supporting outlet 230 extends horizontally from the one of the sides of the base 200. The internal channel (or discharge) 215 of the base 200 is in fluid communication with outlet 230 and the pump chamber 210. Discharge 215 is preferably tangential to the pump chamber 210.

Figure 7D:
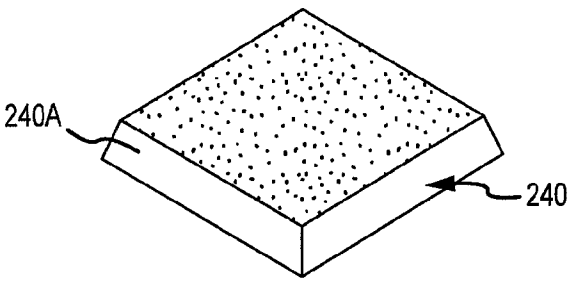
FIG. 7D depicts an isometric view of an embodiment of the filter of FIGS. 7A-7C.
Figure 7C:
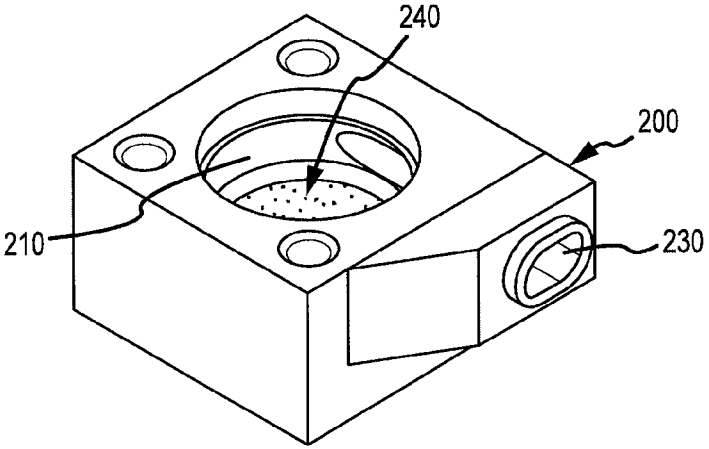
FIG. 7C depicts an isometric view of the embodiment shown in FIGS. 7A and 7B with the filter in the housing.
Figure 7A:
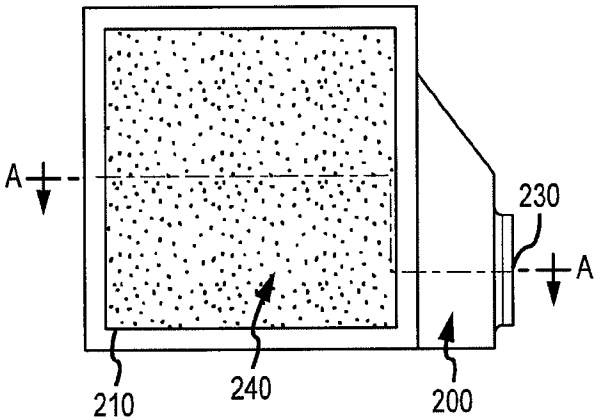
FIG. 7A depicts a bottom view of an embodiment of a molten metal pump base with a filter.
Figure 7B:
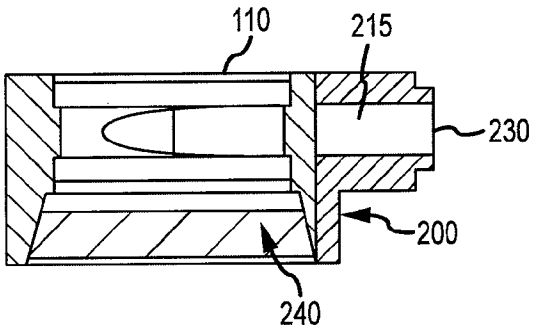
FIG. 7B depicts a side cross-sectional view taken along lines A-A of FIG. 7A of an embodiment of a molten metal pump base with a rotor and filter.
Figure 8B:
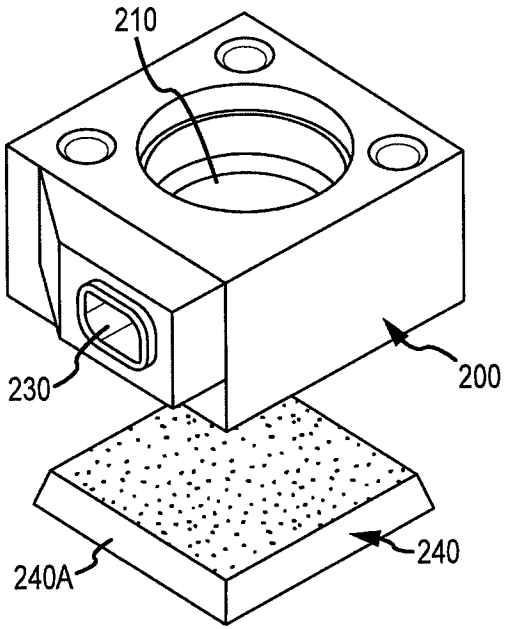
FIG. 8B depicts a top, exploded view of the embodiment depicted in FIG. 8A.
Figure 8A:
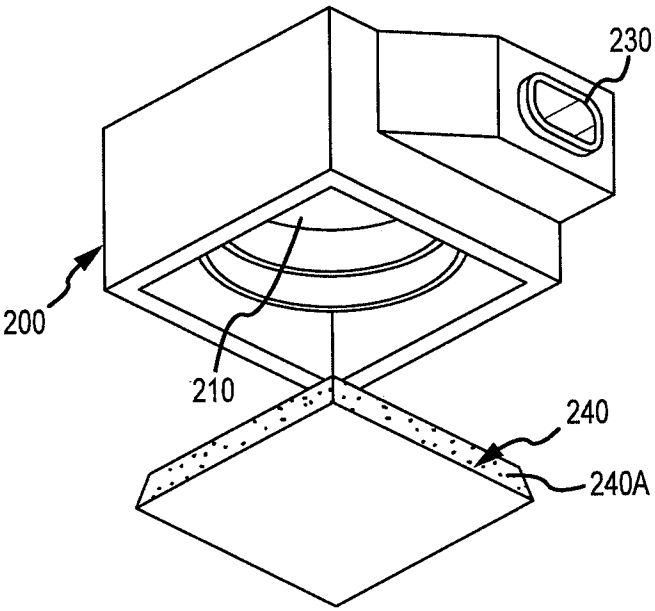
FIG. 8A depicts a bottom, exploded embodiment of a filter and pump base according to the invention.

FIGS. 7A-7D and 8A-8B depict various views of an embodiment of the base 200, rotor 110 and the filter 240. FIG. 7A depicts an expandable gasket 240A surrounding, and attached to, at least a portion of the filter 240. The gasket 240A helps retain the filter 240 within the pump chamber 210. The gasket 240A can be, and preferably is, selected to expand and contract with temperature changes. Among other things, this helps assist in positioning a filter 240 in the base 200 when the two components are at different temperatures (e.g., the filter 240 is at room temperature and the base 200 is at a relatively higher temperature after being submerged in molten metal). The gasket 240A can be of any suitable size, shape, and configuration, be placed at any suitable locations on the filter 240 or the base 200, and is approximately 0.75" thick in the exemplary embodiment.

Figure 9C:
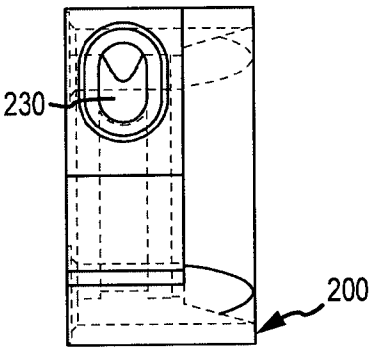
FIG. 9C is a side view of the pump base of FIGS. 9A and 9B.
Figure 9D:
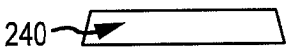
FIG. 9D depicts a side view of the filter of FIGS. 9A-9C.
Figure 9E:
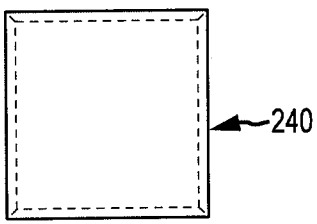
FIG. 9E depicts a top view of the filter of FIGS. 9A-9D.
Figure 9A:
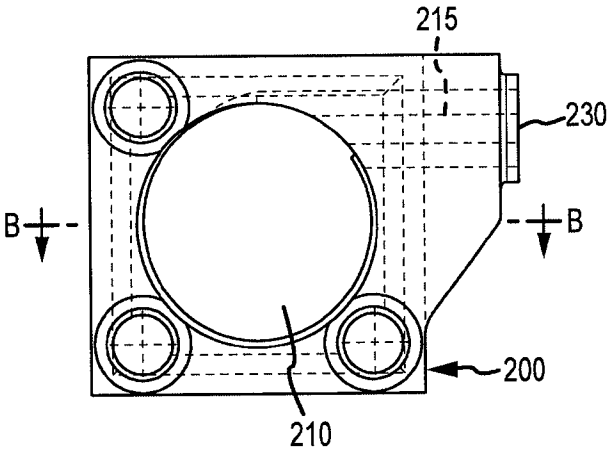
FIG. 9A depicts a top view of an embodiment of a pump base with a rotor and filter according to the invention.
Figure 9B:
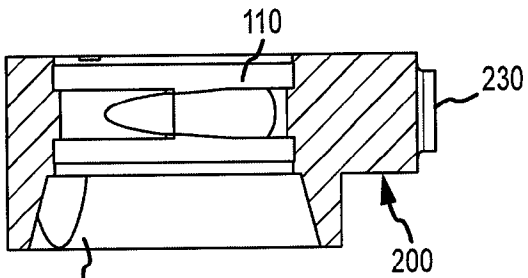
FIG. 9B depicts a side, cross-sectional view of an embodiment of the pump of FIG. 9A.

FIGS. 9A-9C illustrate exemplary dimensions of an embodiment of a base 200 that houses the rotor 110 and retains the filter 240. In this embodiment, the angle of the interior receiving walls of the base 200 is 15 degrees to correspond to the angle of the sidewalls of the filter 240.

Figure 10A:
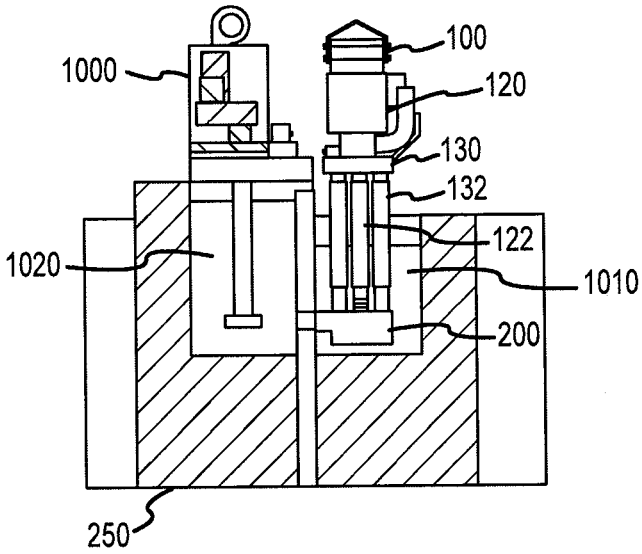
FIG. 10A depicts a side cross-sectional view of a molten metal housing chamber utilizing a circulation pump according to the invention in combination with a rotory degasser.
Figure 10B:
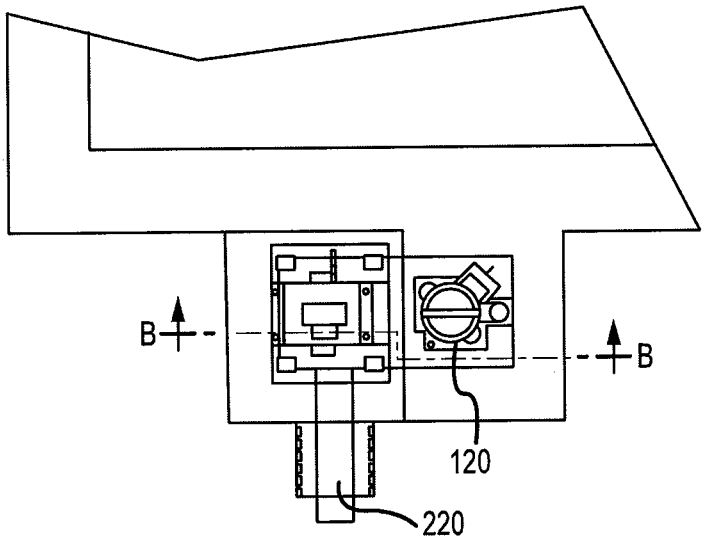
FIG. 10B depicts a top view of the embodiment of the system shown in FIG. 10A.
Figure 10C:
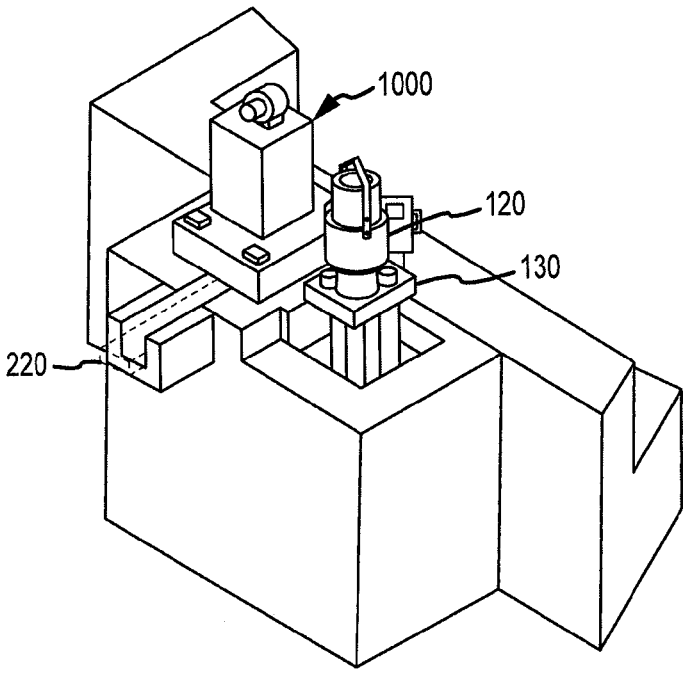
FIG. 10C depicts an isometric view of the system shown in FIGS. 10A and 10B.

FIGS. 10A-10C show an embodiment of the present invention operating in a molten metal bath. In this embodiment, the molten metal pump 100 operates in conjunction with a rotary degas ser 1000. In this embodiment, molten metal in a molten metal bath or charge well 1010 is provided to chamber 1020 for degassing by degasser 1000.

Molten metal may be transferred utilizing the invention as disclosed in one of the embodiments of copending U.S. patent application Ser. No. 11/766,617 to Paul V. Cooper entitled "Transferring Molten Metal from one Structure to Another" filed Jun. 21, 2007 the disclosure of which is incorporated herein by reference.

Figure 11C:
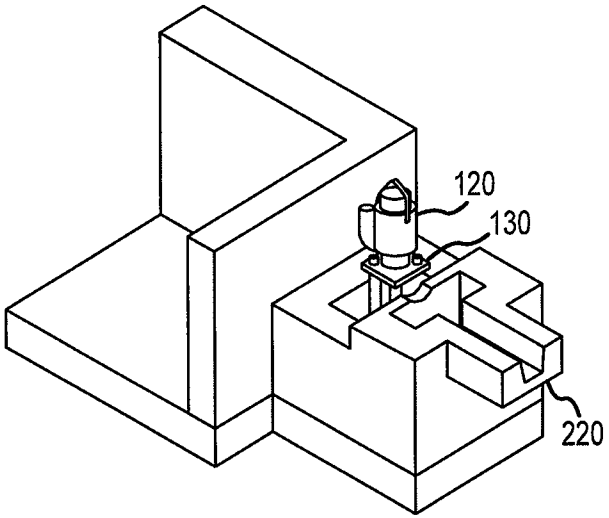
FIG. 11C depicts an isometric view of the system shown in FIGS. 11A and 11B.
Figure 11D:
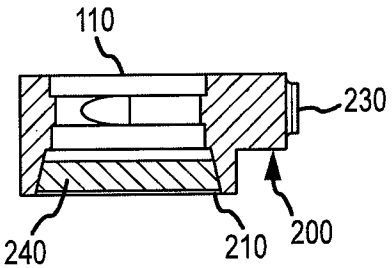
FIG. 11D depicts a cross-sectional view taken through line B-B of FIG. 10B.
Figure 11B:
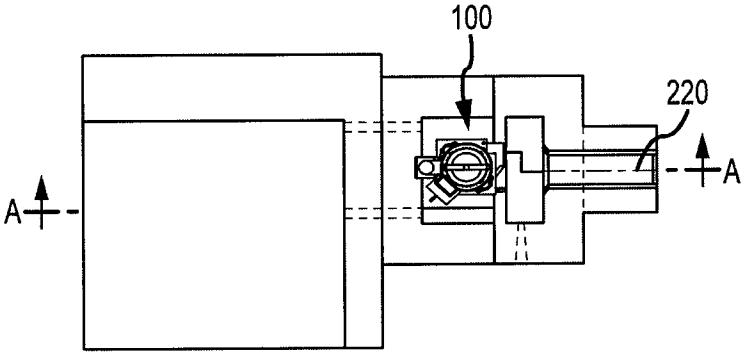
FIG. 11B depicts a top view of the embodiment of FIG. 11A.
Figure 11A:
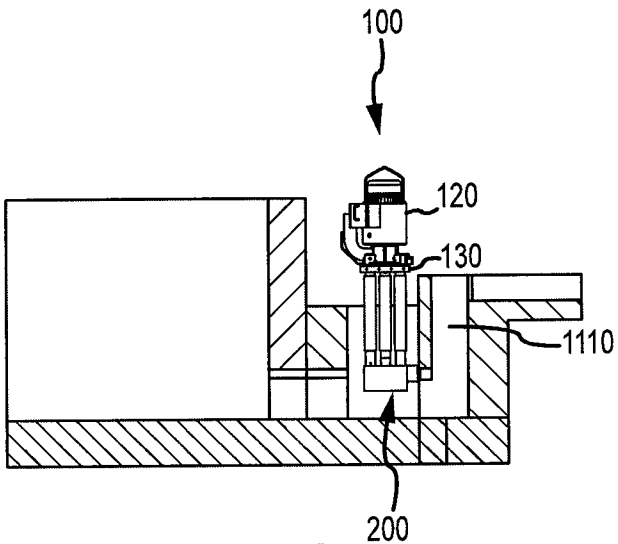
FIG. 11A depicts a side cross-sectional view of a molten metal handling chamber that includes a circulation pump with a filter according to the invention.

FIGS. 11A-11C depict another embodiment of the invention used in a system in a molten metal bath. In this embodiment, the molten metal exiting outlet 230 is directed into a chamber 1110 which gradually fills to a predetermined level. Once the height of the filtered molten metal in the chamber 1110 reaches a height greater than the height of the launder 220, a controlled flow of the molten metal enters launder 220.

This molten metal pump will preferably have a control system to control the speed and quantity of flow of molten metal to the launder.

In alternate embodiments of the present invention, instead of being suspended above the bottom of the molten metal bath, the molten metal pump base 200 may rest on the bottom of the molten metal bath. In such embodiments, or even in embodiments where the pump base 200 is suspended above the bottom of the molten metal bath, the filter 240 may be retained in the side(s) and/or top of the base 200. If coupled to a top surface of the molten metal pump base the filter may be located directly over the rotor 110 or in an alternative location. The filter 240 may be sized, shaped, and configured with relation to the base 200 in any suitable manner to allow molten metal to flow through the filter 240 and ultimately be delivered through outlet port 230.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A molten metal pump base comprising:

an opening configured to receive a molten metal pump filter; and the molten metal pump filter positioned at least partially in the opening, the filter comprised of a ceramic foam material.

2. The molten metal pump base of claim 1, wherein the pump base is comprised of a material having a density, and the ceramic foam material has a density less than the density of the pump base material and is buoyant in molten aluminum.

3. The molten metal pump base of claim 1, further comprising one or more gaskets positioned between at least part of the filter and the pump base, the one or more gaskets designed to expand and contract based on changes in temperature.

4. The molten metal pump base of claim 1, wherein the pump base further includes a pump chamber and a rotor, and the rotor and filter are both retained in the pump chamber.

5. The molten metal pump of claim 1, wherein the pump base further comprises a tapered interior wall against which the filter is positioned.

6. The molten metal pump base of claim 3, wherein the filter has four sides and includes a gasket on at least two of the sides.

7. The molten metal pump base of claim 6, wherein there is a gasket on each of the four sides.

8. The molten metal pump base of claim 1 that is configured to be used in a bottom-feed pump.

9. The molten metal pump base of claim 1, wherein the molten metal pump filter is not comprised of bonded refractory material.

10. The molten metal pump base of claim 1, wherein the molten metal pump filter is not comprised of sintered refractory material.

11. The molten metal pump base of claim 1, wherein the molten metal pump filter is not cemented to the pump base.

12. The molten metal pump of claim 1, wherein the molten metal pump filter is not comprised of silicon carbide.

13. The molten metal pump base of claim 1, wherein the filter has sides, a top surface and a bottom surface, and the sides of the filter are pitched at between approximately a one degree and approximately a 45 degree angle so that the top surface is smaller than the bottom surface.

14. A molten metal bottom-feed pump for filtering molten metal comprising:

a molten metal pump base having a pump chamber, a discharge and outlet port;

a superstructure connected to the pump base by one or more support posts;

a motor on the superstructure;

a drive shaft having a first end connected to the motor and a second end;

a rotor positioned in the pump chamber and connected to the second end of the drive shaft; and a molten metal pump filter positioned at least partially in a bottom opening of the pump chamber and beneath the rotor.

15. The molten metal pump of claim 14 that is a circulation pump.

16. The molten metal pump of claim 14 that is a transfer pump.

17. The molten metal pump of claim 14, further comprising an expandable gasket positioned between at least part of the molten metal filter and the pump base, the gasket configured to expand and contract based on changes in temperature.

18. The molten metal pump of claim 14, wherein the pump base further comprises a tapered interior wall in which the molten metal filter is positioned.

19. The molten metal pump of claim 14, wherein the molten metal filter is not comprised of bonded or sintered refractory material.

20. The molten metal pump of claim 14, wherein the molten metal filter is not cemented to the pump base.

21. The molten metal pump of claim 14, wherein the molten metal filter is not comprised of silicon carbide.

22. The molten metal pump of claim 14, wherein the molten metal filter has sides and each of the sides is pitched at between an approximately 1 and an approximately 45 degree angle.

23. The molten metal pump of claim 14, wherein the pump base is comprised of graphite.

24. The molten metal pump of claim 14, wherein the molten metal pump filter is buoyant in molten aluminum.

25. A filter for use in a molten metal pump base, the pump base comprised of a material having a density, the filter comprised of a porous ceramic and having a density less than the density of the material comprising the pump base, the porous ceramic being buoyant in molten metal aluminum.

26. The filter of claim 25 that has one or more sides and a gasket on at least one of its sides, the gasket comprising a material that expands when heated.

27. The filter of claim 25 that is not comprised of bonded or sintered refractory material or of silicon carbide.

28. The filter of claim 25 that has sides and each of the sides is pitched at approximately a 15° angle.

29. The filter of claim 25 that has sides and each of the sides is pitched at approximately a 45° angle.

30. The molten metal pump of claim 14 wherein the filter has sides and each of the sides is pitched at approximately a 15° angle.

31. The molten metal pump of claim 1 wherein the filter has sides and each of the sides is pitched at approximately a 15° angle.

* * * * *